US008830797B2

(12) United States Patent
Dubugnon et al.

(10) Patent No.: US 8,830,797 B2
(45) Date of Patent: Sep. 9, 2014

(54) TIMEPIECE

(75) Inventors: Dominique Dubugnon, Etoy (CH); Adrien Farron, Neuchâtel (CH); Christian Fleury, Challex (FR)

(73) Assignee: Rolex S.A., Geneva (CH)

( * ) Notice: Subject to any disclaimer, the term of this patent is extended or adjusted under 35 U.S.C. 154(b) by 398 days.

(21) Appl. No.: 13/287,469

(22) Filed: Nov. 2, 2011

(65) Prior Publication Data

US 2012/0127835 A1 May 24, 2012

(30) Foreign Application Priority Data

Nov. 3, 2010 (EP) ..... 10405209

(51) Int. Cl.

| | |
|---|---|
| ***G04B 19/247*** | (2006.01) |
| ***G04B 19/253*** | (2006.01) |
| ***G04B 19/24*** | (2006.01) |
| ***G04B 19/04*** | (2006.01) |

(52) U.S. Cl.

CPC ..... *G04B 19/046* (2013.01); *G04B 19/25353* (2013.01); *G04B 19/24* (2013.01)

USPC ..... 368/37; 368/228; 368/232

(58) Field of Classification Search

USPC ..... 368/28, 35, 37, 228, 232

See application file for complete search history.

(56) References Cited

U.S. PATENT DOCUMENTS

| | | | | | |
|---|---|---|---|---|---|
| 142,975 | A | * | 9/1873 | Worhley | 368/37 |
| 268,902 | A | * | 12/1882 | Jacquemin | 368/37 |
| 368,961 | A | * | 8/1887 | Morton | 368/37 |
| 1,906,908 | A | * | 5/1933 | Hoffmann | 40/107 |
| 2,583,797 | A | | 1/1952 | Rosfelder | |
| 4,257,113 | A | | 3/1981 | Meister et al. | |
| 4,541,725 | A | * | 9/1985 | Baumgartner et al. | 368/37 |
| 4,632,569 | A | | 12/1986 | Gogniat | |
| 6,154,421 | A | * | 11/2000 | Solomon | 368/28 |
| 2003/0112707 | A1 | | 6/2003 | Berard | |

FOREIGN PATENT DOCUMENTS

| | | | |
|---|---|---|---|
| CH | 685585 | G A3 | 8/1995 |
| CH | 689601 | A5 | 6/1999 |
| CH | 691149 | A5 | 4/2001 |
| CH | 695227 | A5 | 1/2006 |

(Continued)

OTHER PUBLICATIONS

European Search Report of EP10405209, mailing date Apr. 28, 2011.

*Primary Examiner* — Vit W Miska

(74) *Attorney, Agent, or Firm* — Westerman, Hattori, Daniels & Adrian, LLP

(57) ABSTRACT

This timepiece comprises an indicator dial (40), a days-of-the-month mechanism (1) comprising a days-of-the-month mobile (10) and a stepper drive member (13) for driving the days-of-the-month mobile (10), a months mobile (30) coaxial with the days-of-the-month mobile placed beneath said dial (40) and connected to the days-of-the-month mobile (10) by stepper drive means (12, 20) formed so that the months mobile (30) turns through an angle of 30° each month. The dial (40) has twelve windows (41) that are angularly equidistant and the months mobile (30) supports a distinctive zone (32) of which the trajectory passes through said windows (41) and of which the maximum angular extent is 30° and the minimum angular extent corresponds to that of said windows (41).

20 Claims, 8 Drawing Sheets

(56) References Cited

FOREIGN PATENT DOCUMENTS

| | | | |
|---|---|---|---|
| EP | 1158374 | A1 | 11/2001 |
| FR | 2453439 | A1 | 10/1980 |
| GB | 661411 | A | 11/1951 |
| GB | 1406718 | A | 9/1975 |

* cited by examiner

TIMEPIECE

The present invention relates to a timepiece comprising an indicator dial, a days-of-the-month mechanism comprising a days-of-the-month mobile and a stepper drive member of this mobile, a months mobile placed beneath said indicator dial and connected to the days-of-the-month mobile by stepper drive means formed so that this months mobile turns through an angle of 30° each month.

If the calendar is annual or perpetual, the presence of the month indication is necessary for the adjustment of the watch. However, because of the complexity of the majority of annual or perpetual calendars of the market, there is a risk of experiencing unsynchronized jumps between the various indications, which may lead to uncertainty in reading the date.

As illustrated in document CH685585, the incorporation of an additional mechanism making it possible to display the indication of the months usually requires the installation of one or more additional indexing jumpers. On the other hand, the energy accumulator of the days-of-the-month mechanism must deliver an additional amount of energy in order to be able to overcome the total of the torques produced by the multiple jumpers. The loss of energy that results from this in the balance wheel-hairspring risks causing a reduction in its amplitude and harming the accuracy of the watch. The solution aimed at reducing the torques of the jumper springs is not indicated because it risks causing trailing jumps or undesirable double jumps of date.

CH 695 227 describes an instantaneous-jump perpetual days-of-the-month mechanism of which the days-of-the-month mobile comprises two large, superposed date disks. The first disk supports the dates of the first fifteen days of the month and the second disk those going from the 16th to the 31st. A window is arranged in the first disk between the 15th and the 1st of the month so that the days of the month of the second disk can be visible from the 16th. The operation of this calendar is dependent on the cooperation and the synchronization of these two disks which are each rotated by their internal tooth gear engaged with a distinct driving mobile.

The programming and the driving of the disks is carried out by means of an auxiliary cam, a control lever and subsidiary sprung switches, mounted on the first disk, and which cooperate with the geometry of the second. The months indication is provided by a small hand, placed in the center of the movement, which points toward one of the twelve hour numbers also serving as the months numbers. The wheel that supports the months hand has no indexing spring and is directly engaged with the days-of-the-month indicator mobile via a gear train and a Maltese cross for locking and driving.

This solution has the drawback of using a connection of the tenon-Maltese cross type that is particularly sensitive to the radial clearances of the elements of the gear train. This solution requires a perfect control of the tolerances of the pivoting clearances with the risk of experiencing butting problems. Furthermore, the angular clearances of the mobiles of the gear train system have a direct effect on the positioning of the months hand. Thus, the alignment of the months hand with the hours number seems to be tricky. Also, in the event of an impact, the angular variation of the days-of-the-month disk will have a direct effect on the positioning of the hand.

One solution consists in shortening the months hand as much as possible but this is detrimental to ease of reading.

Another drawback lies in the fact that the calendar driving mobile must drive the days-of-the-month disks over an angular step close to twice as large as normal. This has consequences from the point of view of energy consumption and therefore on the accuracy of the watch. Furthermore, when there is a change of date at the end of the short months, the instantaneity of the jumps is ensured by the springs of the first disk cooperating with the geometry of the periphery of the second days-of-the-month disk. This mechanism is difficult to develop. The risk of experiencing a trailing jump of date and therefore uncertainty in reading this display is far from being negligible.

The object of the present invention is to at least partly remedy the aforementioned drawbacks.

Accordingly, the subject of the invention is a timepiece as claimed in claim 1.

Several embodiments are defined by claims 2 to 10.

This device for displaying the months may be associated both with a conventional calendar and with an annual calendar as described in EP 1 596 261, or with a perpetual calendar.

Advantageously, the distinctive zone of the months mobile which appears in one of the twelve windows made in the dial has an angular extent that is greater than that of this window, so that any clearance of this mobile becomes undetectable.

By virtue of the invention, the angular movement of the months mobile can take place over several days. By using a distinctive zone extending over an angular sector from 20° to 30°, the transition from one month to another appears to be instantaneous, although in reality the monthly advance of the months mobile takes place over several days. By this method, the energy necessary for its movement can be distributed over a longer period. This may be advantageous in the case of an annual or perpetual calendar, because the mechanism must be able to string together two, three or even four consecutive days-of-the-month jumps.

According to the preferred embodiment, the days-of-the-month mobile and the months mobile turn in opposite directions. Consequently, the unwanted angular movements of these two mobiles cancel one another out and no sequence errors between the indications given by these mobiles can be caused, particularly in the event of impacts.

Other advantages and specific features will appear in the light of the following description relating to one embodiment and two variants of the invention illustrated schematically and as examples by the appended figures.

Figure 1:
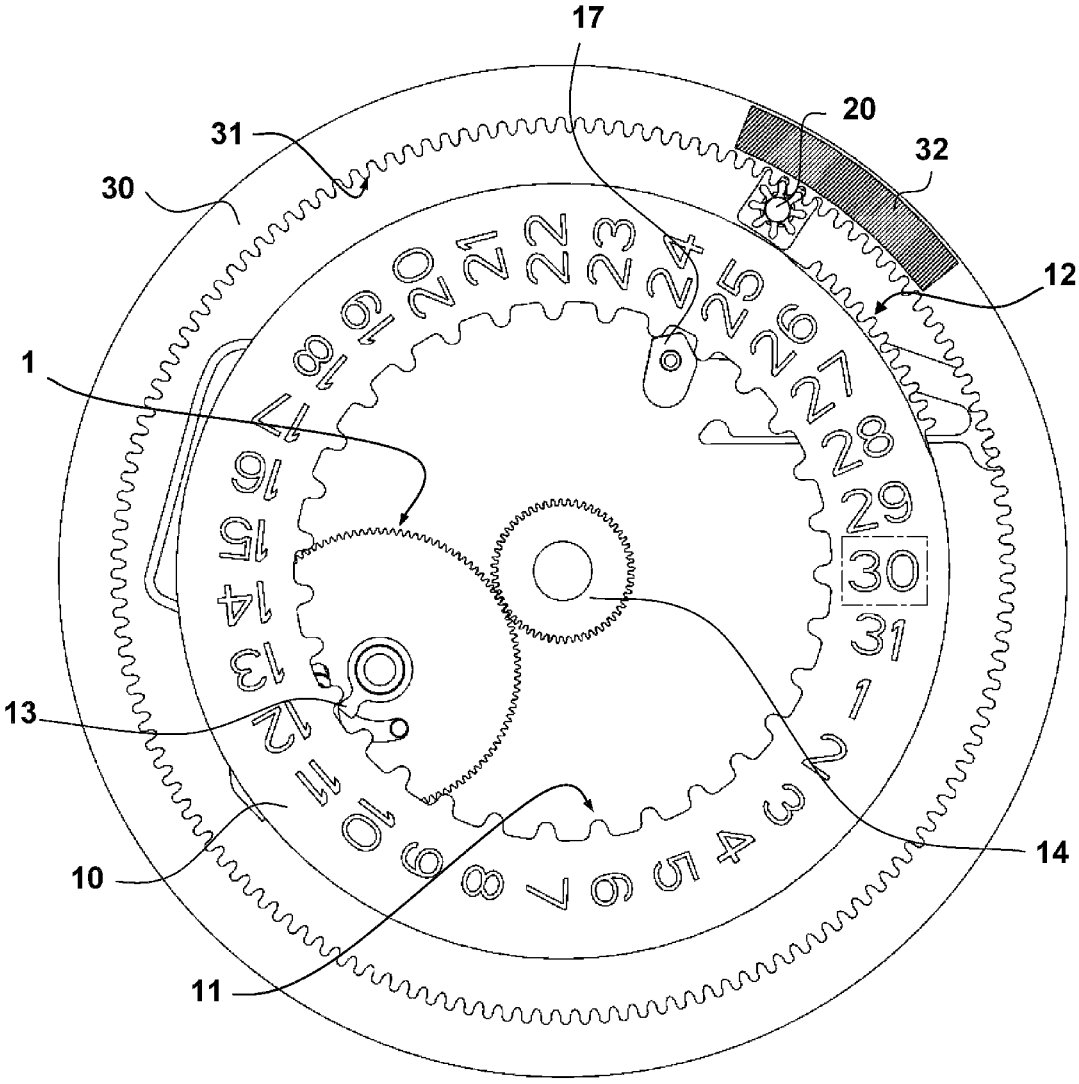
FIG. 1 is a plan view of this first embodiment.
Figure 2:
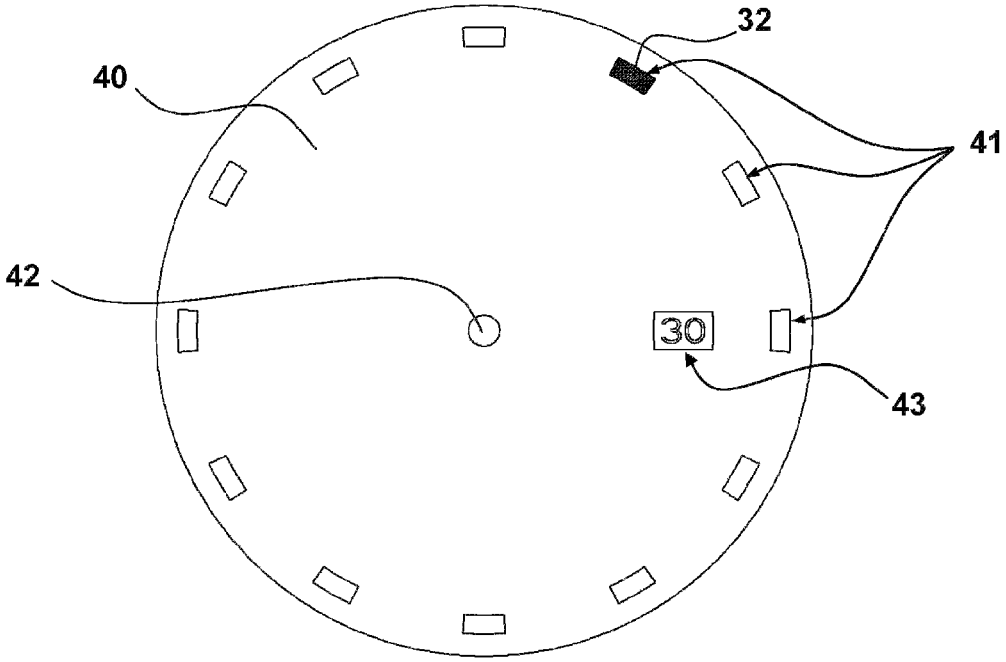
FIG. 2 is a plan view of the display associated with this first embodiment.
Figure 3A:
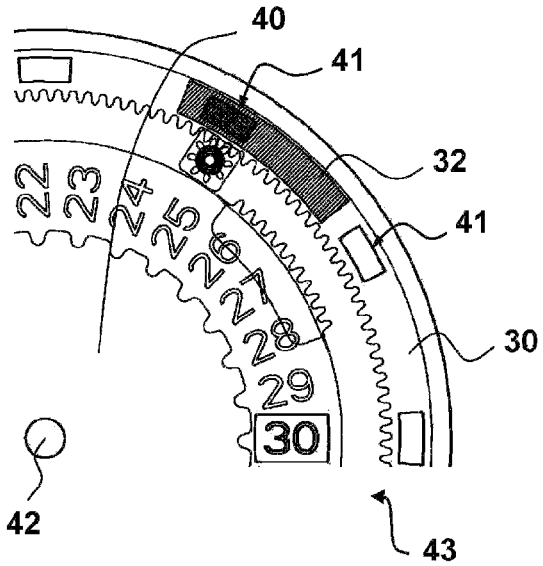
Figure 3A:
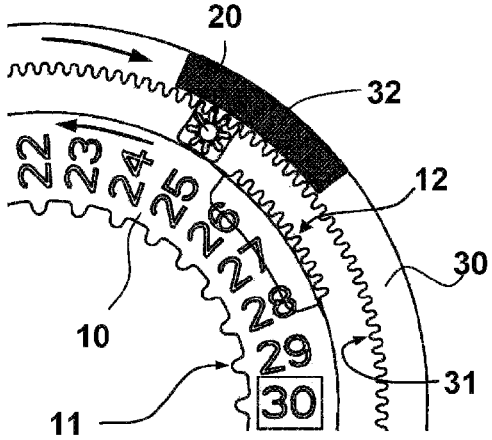

FIGS. 3*a*, 3*a*' to 3*e*, 3*e*' are partial plan views of FIGS. 1 and 2 illustrating the sequential passage of the indication from one month to another.

Figure 4:
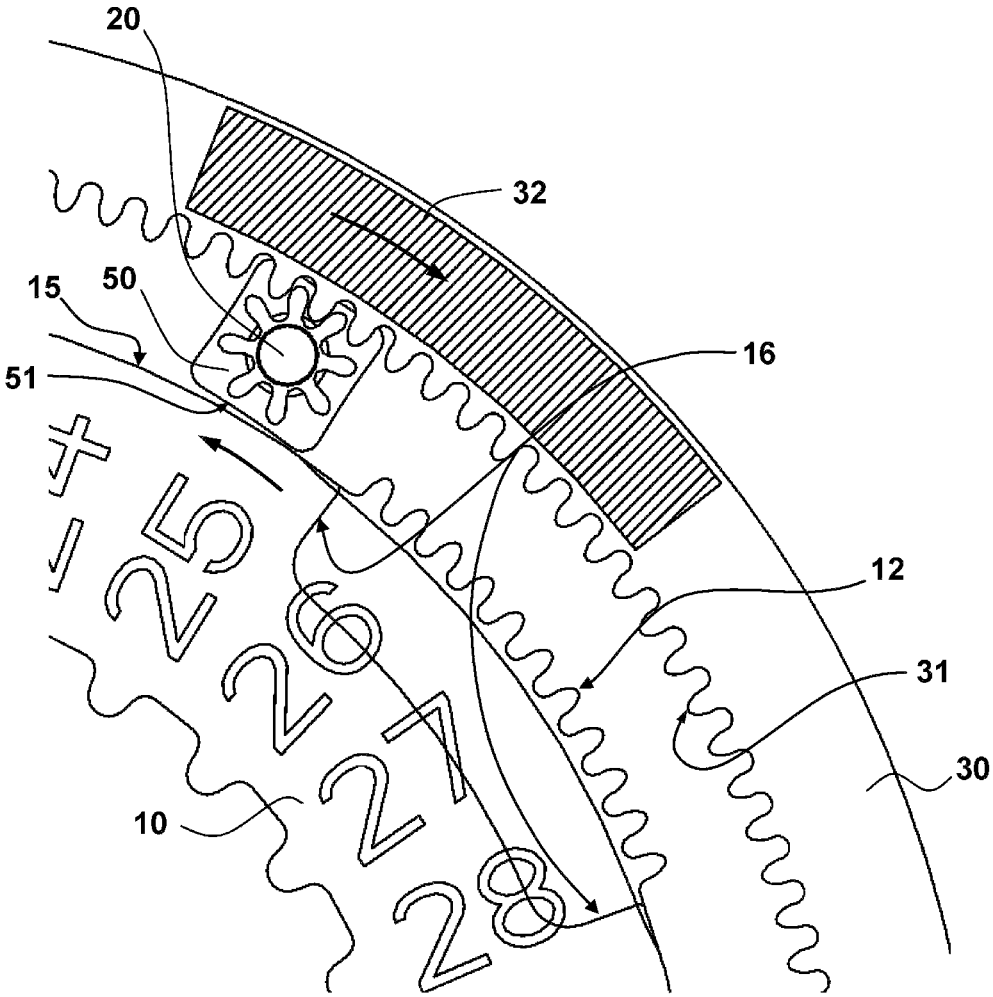

FIG. 4 is a partial view of FIG. 1.

Figure 5:
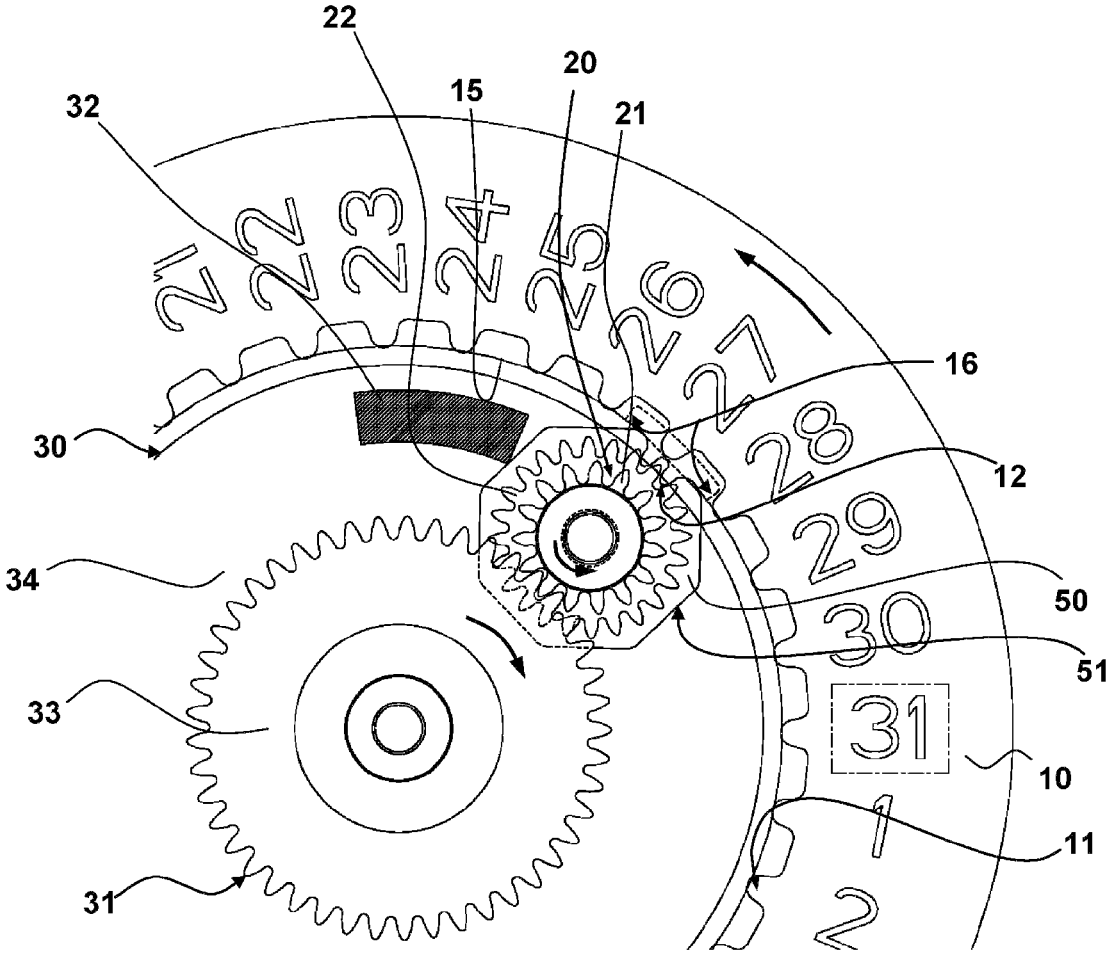
Figure 6:
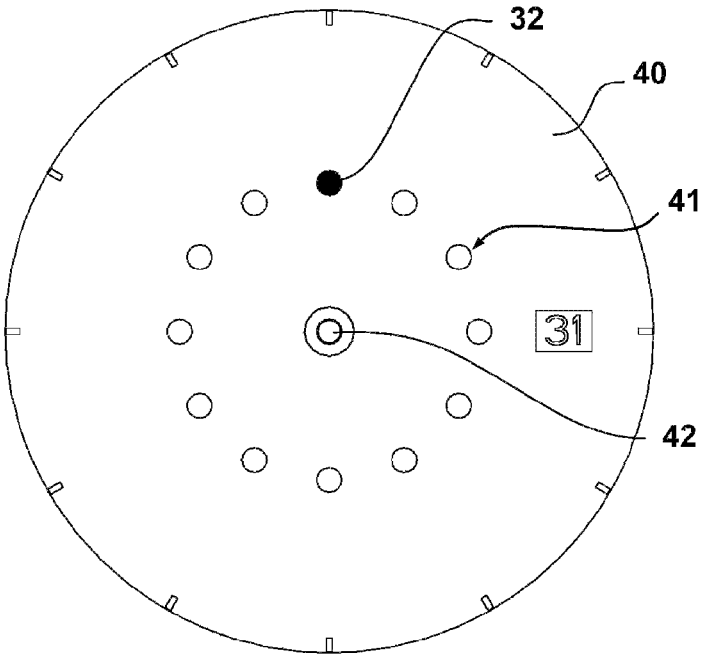

FIGS. 5 and 6 are plan views similar to FIGS. 1 and 2 of a first variant of the invention.

Figure 7A:
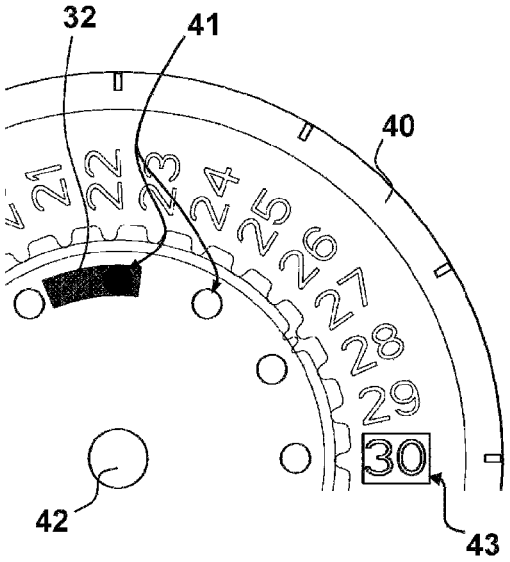
Figure 7A:
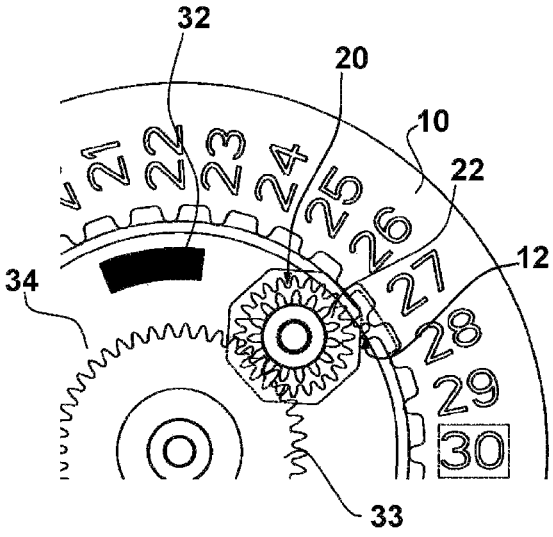

FIGS. 7*a*, 7*a*' to 7*c*, 7*c*' are representations similar to those of FIGS. 3*a*, 3*a*' of the first variant of the invention.

Figure 8A:
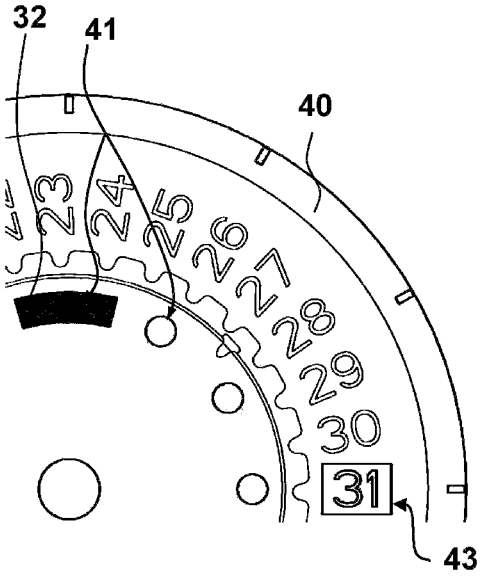
Figure 8A:
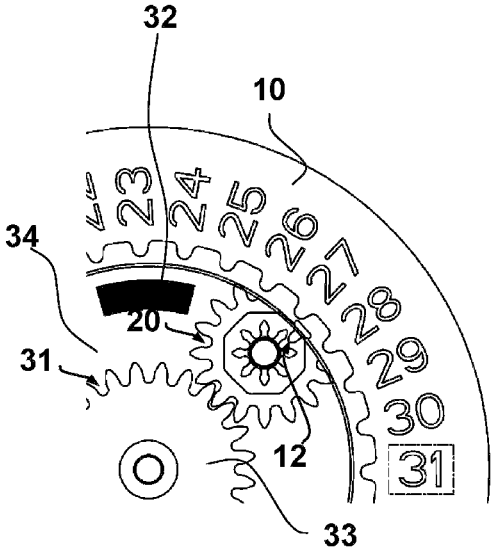

FIGS. 8*a*, 8*a*' and 8*b*, 8*b*' are plan views similar to those of FIGS. 7*a*, 7*a*' of a second variant of the invention.

FIG. 1 represents a days-of-the-month mechanism 1 of a timepiece, rotated by an hours wheel 14. This mechanism comprises a days-of-the-month mobile 10 preferably taking the form of a ring provided with a first annular tooth gear 11 comprising thirty-one teeth. This tooth gear is engaged with an instantaneous jump stepper drive member 13 of known type, and is indexed angularly by only one jumper 17. The days-of-the-month mobile 10 comprises a second tooth gear formed by a toothed sector 12, designed to mesh with an intermediate mobile 20 engaged with a months mobile 30 which takes the form of a ring gear 31 with internal teeth engaged with the intermediate mobile 20.

This months mobile supports a distinctive zone 32 on its face lying beneath an indicator dial 40 (FIG. 2). This dial has twelve windows 41 that are angularly equidistant. The distinctive zone 32 is preferably a zone colored with a color having a good contrast with that of the dial and with that of the months ring gear 30, but it may also be a transparent zone which reveals a color of the watch case which has a good contrast with that of the watch and with that of the months ring gear 30.

The maximum extent of the distinctive zone 32 is limited to an angular sector equal to 30° while its minimum angular extent is not less than that of a window 41.

When the toothed sector 12 meshes with the intermediate mobile 20, it operates the latter through a given angle. Since the days-of-the-month mobile turns through an angular step equivalent to one thirty-first of a revolution per step, the angle of the toothed sector 12 influences the number of jumps made monthly by the months mobile 30. The gear ratio of the toothed sector 12 and of the intermediate mobile 20 is chosen so that the months mobile turns through an angle of 30° on at least one step of the days-of-the-month mobile. The number of steps is limited by the angular extent of the window; the larger the latter is the fewer the number of admissible steps.

FIGS. 3*a*-3*a*' to 3*e*-3*e*' illustrate the sequences of the months mobile 30 for a change of month that takes place in four days, that is to say in four steps of the days-of-the-month mobile 10.

FIG. 3*a* shows a portion of the months mobile 30 seen transparently through the indicator dial 40. The latter displays the day of the month 30 of a 31-day month through the window 43, for example, January 30th. FIG. 3*a*' shows the meshing of the intermediate mobile 20 with the days-of-the-month mobile 10 on the one hand and with the months mobile 30 on the other hand.

Since the toothed sector 12 of the days-of-the-month mobile is an external tooth gear and the intermediate mobile 20 consists of a pinion which meshes directly with this toothed sector 12 on the one hand, and with the internal tooth gear 31 of the months mobile on the other hand, the days-of-the-month mobile and the months mobile turn in opposite directions. In the example described, the months mobile 30 turns in the clockwise direction while that of the days of the month 10 turns in the reverse direction.

Note that on January 30th the intermediate mobile 20 is not yet engaged with the days-of-the-month mobile 10. As illustrated by FIG. 3*a*, the distinctive zone 32 fills the window 41 which corresponds to the indication of the month of January.

Figure 3B:
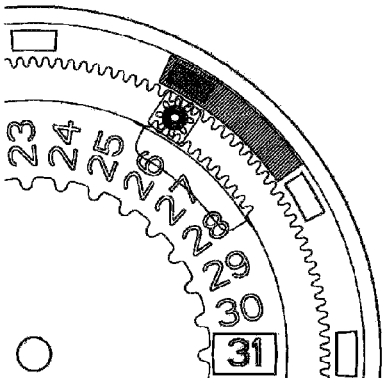
Figure 3B:
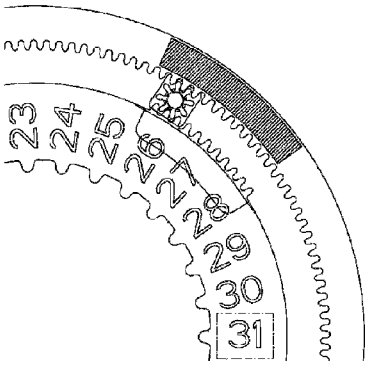

FIGS. 3*b*, 3*b*' show the mechanism on January 31st, after a first date jump. The angular movement of a step of the days-of-the-month mobile 10 has placed the toothed sector 12 in engagement with the intermediate mobile 20. The result of this is a slight rotation of the months mobile 30 during which the rear end of the distinctive zone 32 is brought closer to the edge of the window 41 of the month of January.

Figure 3C:
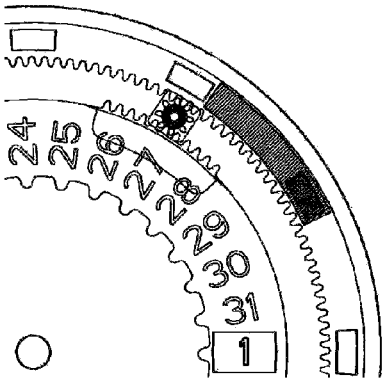
Figure 3C:
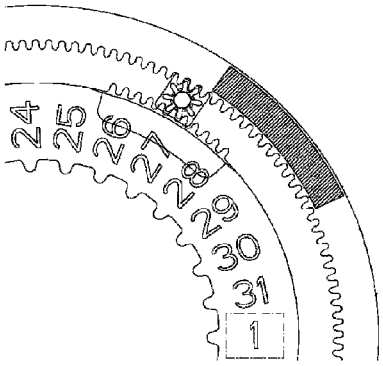

FIGS. 3*c*, 3*c*' shows the respective positions of the mobiles after the second step which corresponds to the passage from January 31st to February 1st. In FIG. 3*c*', the intermediate pinion 20 is in the middle of the toothed sector 12. Since this pinion was already engaged with the tooth gear 31 of the months mobile 30 just before the second step, the latter is rotated by the intermediate mobile 20 throughout the second step of the days-of-the-month mobile 10. The result of this is a greater angular movement of the months mobile 30 than during the previous step illustrated by FIGS. 3*a*-3*a*' and 3*b*, 3*b*'. As illustrated by FIG. 3*c*, the greater angular movement during the second step allows the distinctive zone 32 to instantaneously leave the previous window 41 and to appear simultaneously in the next window 41 while filling it.

Figure 3D:
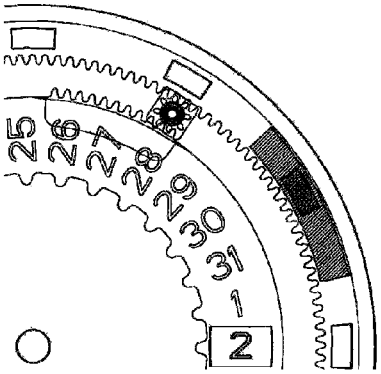
Figure 3D:
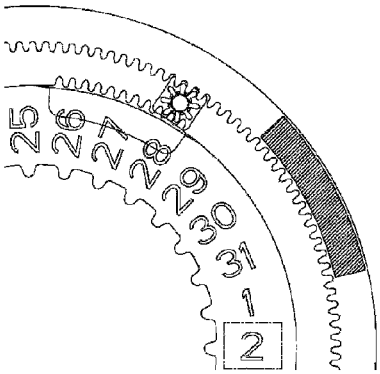

The position after the third step is shown in FIGS. 3*d*, 3*d*', the display indicating February 2nd. Note that the intermediate pinion 20 is at the exit of the toothed sector 12, in a position symmetrical to that of FIG. 3*b*' in which this pinion 20 is at the entrance of this toothed sector.

Figure 3E:
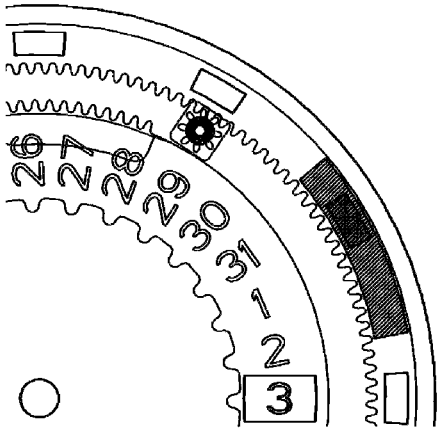
Figure 3E:
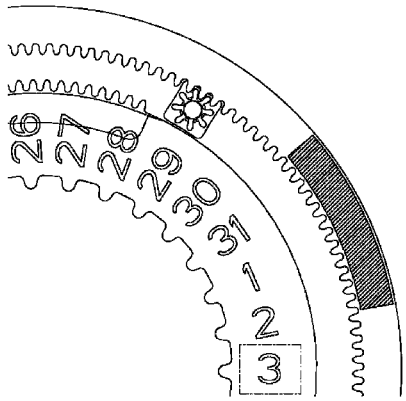

FIGS. 3*e*, 3*e*' illustrate the position of the mechanism after the fourth and last step. With respect to the toothed sector 12, the intermediate pinion 20 is in a similar position to that which it occupied before the first step, as shown in FIG. 3*a*'.

Looking at FIGS. 3*a* to 3*e*, it is noted that the mechanism described makes it possible to obtain an instantaneous change of the months, while the rotation of the months mobile takes place over several days, in as many steps.

A nonelastic angular locking member 50 for locking the months mobile 30 is secured to the intermediate pinion 20 and is used to prevent any unwanted rotation of the months mobile 30 when the intermediate pinion 20 is not engaged with the toothed sector 12.

As shown in FIG. 4, this angular locking member comprises at least one locking surface 51 engaged with a circular surface 15, concentric with and secured to the days-of-the-month mobile 10. This locking surface is interrupted over an angular portion 16 at least equal to and coincident with that of the toothed sector 12. This interruption makes it possible to deactivate the angular locking member 50 in order to allow the rotation of the locking surface 51 when the toothed sector 12 is engaged with the intermediate pinion 20.

In the example shown, the angular locking member 50, which operates according to a Maltese cross principle, takes the form of a square of which each side forms a locking surface 51.

By associating the angular locking member 50 with the intermediate pinion 20, only one member makes it possible alternately to operate, to index and to lock the months mobile.

FIGS. 5 and 6 show a first variant of the months display device, in which the distinctive zone 32 of the months mobile 30 is arranged on a disk 34 which is secured to and concentric with a toothed mobile 33 with an external tooth gear. The toothed sector 12 of the days-of-the-month mobile 10 is arranged on the internal edge of this mobile 10. The intermediate mobile 20 comprises two coaxial pinions 21 and 22. The pinion 21 meshes with the toothed mobile 33 while the pinion 22 is periodically engaged with the toothed sector 12 of the days-of-the-month mobile 10.

In this first variant, the operation of the months mobile 30 takes place over two steps of the days-of-the-month mobile 10 as shown in FIGS. 7*a*-7*a*' to 7*c*-7*c*'.

The display of the days of the month on the dial 40 of FIG. 7*a* indicates, for example, December 30th. The distinctive zone 32 supported by the disk 34 of the months mobile 30 is seen transparently through the indicator dial 40. At this moment, it can be seen in FIG. 7*a*' that the toothed sector 12 of the days-of-the-month mobile is not engaged with the second pinion 22.

Figure 7B:
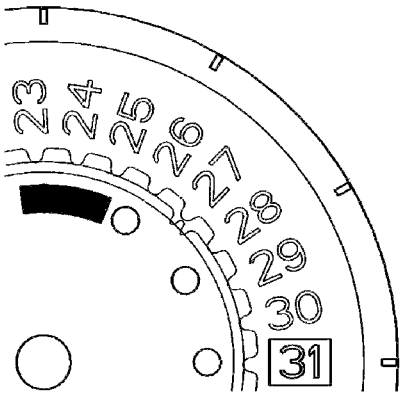
Figure 7B:
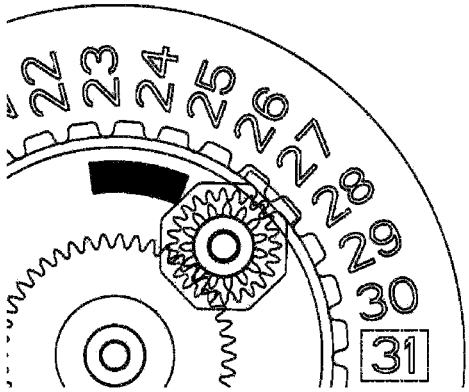

FIGS. 7*b* and 7*b*' show the position of the mechanism following the first step of the operation of the mobile 33. FIG. 7*b* shows that the distinctive zone 32 supported by the disk 34 still appears in the window 41 of the month of December while the day of the month 31 appears in the window 43. Comparing FIGS. 7*a* and 7*b*, it can be seen that the distinctive zone 32 has moved through almost the whole of its angular extent but without encroaching on the next window corresponding to the month of January.

Figure 7C:
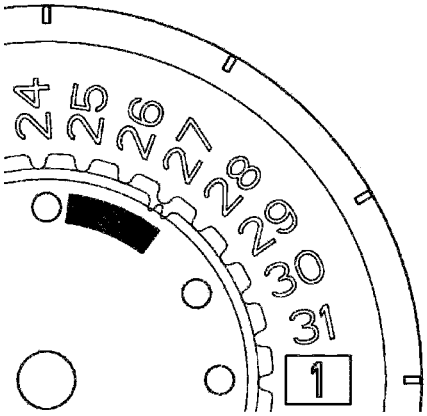
Figure 7C:
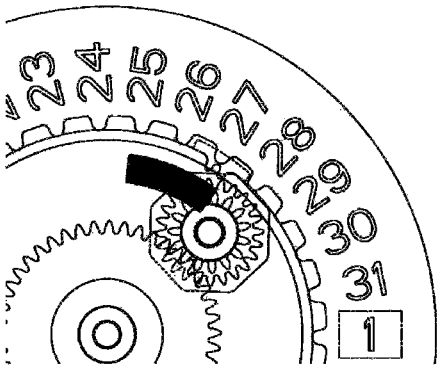

FIGS. 7*c* and 7*c*' show the positions of the mechanism after the second step during which the days-of-the-month mobile 10 and the months mobile 30 are in engagement.

The angular locking member 50 shown in FIG. 5 operates on the same principle as that shown in FIG. 4. Since it is associated with the intermediate mobile 20 with a different angular step from that of the intermediate mobile of the previous embodiment, this locking member is in this instance an octagon that is concentric with the pinions 21 and 22. Moreover, since the toothed sector 12 of the days-of-the-month mobile 10 is an internal tooth gear, the circular locking surface 15 is concave while it is convex in FIG. 4. This locking surface is also interrupted over an angular portion 16 that is at least equal to and coincident with that of the toothed sector 12.

According to this variant, the windows 41 of the months display are situated closer to the center of the dial 40. On the other hand, the months display according to the first embodiment illustrated by FIG. 1 makes it possible to clear away the central portion of the dial which can be used for displaying another time-related indication for example.

Figure 8B:
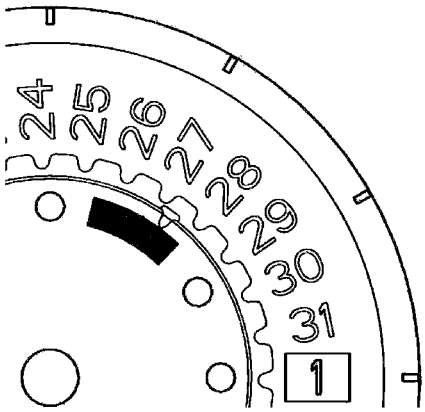
Figure 8B:
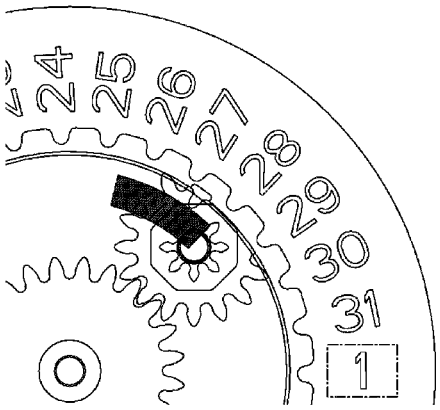

The second variant illustrated by FIGS. 8*a*-8*a*' and 8*b*-8*b*' comprises a mechanism that is totally similar to that of FIGS. 7*a*-7*a*'. In this instance, each angular movement of the months mobile 30 takes place during a single step of the days-of-the-month mobile, after the display of the 31st day of the month by this mobile. Thus, the gear ratios between the various mobiles involved are formed so that the months mobile turns through 30° when the days-of-the-month mobile moves from the 31st to the 1st as shown in FIGS. 8*a* and 8*b* in which it can be seen that the relative position of the distinctive zone 32 with respect to the window 41 in which it appears is always identical irrespective of the date indicated in the window 43. As shown in FIGS. 8*a*' and 8*b*', the toothed sector 12 of the days-of-the-month mobile is reduced to a single tooth.

The mechanism for displaying the months described above may be associated without distinction with a simple, annual or perpetual, calendar mechanism with or without instantaneous jump.

Irrespective of the embodiment and inasmuch as the days-of-the-month mechanism fitted to the timepiece has instantaneous jump, the change of month as it appears on the dial 40 is also instantaneous and synchronized with the jump of the days-of-the-month mobile passing from 31st to 1st.

By virtue of this mechanism, the angular movements of the months mobile resulting from the clearances in the operating mechanism are not detectable in the windows 41 of the dial 40. Moreover, the mechanism according to the invention requires no indexing jumper in addition to the jumper 17, which additional jumper generates a loss of energy, and the mechanism makes it possible to distribute the energy necessary for the passage of the month over several days-of-the-month jumps.

Preferably, the distinctive zone 32 consists of an annular segment or of a circular sector of a color that is chosen to contrast with that of the support on which it is associated and with that of the dial 40. The extent of this distinctive zone is sufficient to fill a window 41. The angular dimension of this window relative to the center 42 of the dial 40 is typically between 5° and 20°, preferably around 10°.

The invention claimed is:

1. A timepiece comprising an indicator dial, a days-of-the-month mechanism comprising a days-of-the-month mobile and a stepper drive member for driving the days-of-the-month mobile, a months mobile placed beneath said indicator dial and connected to the days-of-the-month mobile by stepper drive means formed so that the months mobile turns through an angle of 30° each month, wherein said indicator dial has twelve windows that are angularly equidistant, said months mobile supporting a distinctive zone of which the trajectory passes through said windows and of which the angular extent is situated between a minimum corresponding to the angular extent of one of said windows and a maximum of 30°, wherein said stepper drive means connecting the days-of-the-month mobile to the months mobile comprise a toothed sector and an intermediate mobile on the one hand, constantly engaged with a tooth gear secured to the months mobile which extends over 360° and, on the other hand, periodically engaged with said toothed sector.

2. The timepiece as claimed in claim 1, wherein said intermediate mobile is secured to a nonelastic angular locking member of the months mobile.

3. The timepiece as claimed in claim 2, wherein said angular locking member of the months mobile comprises at least one locking surface engaged with a circular surface that is concentric with and secured to the days-of-the-month mobile and which has an interruption over an angular portion at least equal to and coincident with that of said toothed sector.

4. The timepiece as claimed in claim 1, wherein said months mobile is a ring gear with internal teeth and said toothed sector of the days-of-the-month mobile is an external tooth gear.

5. The timepiece as claimed in claim 1, wherein said months mobile comprises an external tooth gear secured to and concentric with a disk supporting said distinctive zone and wherein said toothed sector is an internal tooth gear.

6. The timepiece as claimed in claim 1, wherein said stepper drive means are formed so that said months mobile turns through said angle of 30° in at least one step of the days-of-the-month mobile.

7. The timepiece as claimed in claim 1, wherein said stepper drive means are formed so that said months mobile turns through said angle of 30° in a number of steps≥2 of the days-of-the-month mobile.

8. The timepiece as claimed in claim 5, wherein said intermediate mobile comprises a first pinion engaging with said external tooth gear of the months mobile and a second pinion concentric with and secured to the first, engaged periodically with said toothed sector of the days-of-the-month mobile.

9. The timepiece as claimed in claim 1, wherein said stepper drive member of the days-of-the-month mobile has instantaneous jump.

10. The timepiece as claimed in claim 1, wherein the angular extent of the distinctive zone is more than the angular extent of one of said windows and at most 30°.

11. A timepiece comprising an indicator dial, a days-of-the-month mechanism comprising a days-of-the-month mobile and a stepper drive member for driving the days-of-the-month mobile, a months mobile placed beneath said indicator dial and connected to the days-of-the-month mobile by stepper drive means formed so that the months mobile turns through an angle of 30° each month, wherein said indicator dial has twelve windows that are angularly equidistant, said months mobile supporting a distinctive zone of which the trajectory passes through said windows and of which the angular extent is situated between a minimum corresponding to the angular extent of one of said windows and a maximum of 30°, wherein said stepper drive means are formed so that said months mobile turns through said angle of 30° in a number of steps≥2 of the days-of-the-month mobile.

12. The timepiece as claimed in claim 11, wherein said stepper drive means connecting the days-of-the-month mobile to the months mobile comprise a toothed sector and an intermediate mobile on the one hand, constantly engaged with a tooth gear secured to the months mobile which extends over 360° and, on the other hand, periodically engaged with said toothed sector.

13. The timepiece as claimed in claim 12, wherein said intermediate mobile is secured to a nonelastic angular locking member of the months mobile.

14. The timepiece as claimed in claim 13, wherein said angular locking member of the months mobile comprises at least one locking surface engaged with a circular surface that is concentric with and secured to the days-of-the-month mobile and which has an interruption over an angular portion at least equal to and coincident with that of said toothed sector.

15. The timepiece as claimed in claim 12, wherein said months mobile is a ring gear with internal teeth and said toothed sector of the days-of-the-month mobile is an external tooth gear.

16. The timepiece as claimed in claim 12, wherein said months mobile comprises an external tooth gear secured to and concentric with a disk supporting said distinctive zone and wherein said toothed sector is an internal tooth gear.

17. The timepiece as claimed in claim 16, wherein said intermediate mobile comprises a first pinion engaging with said external tooth gear of the months mobile and a second pinion concentric with and secured to the first, engaged periodically with said toothed sector of the days-of-the-month mobile.

18. The timepiece as claimed in claim 11, wherein said stepper drive member of the days-of-the-month mobile has instantaneous jump.

19. The timepiece as claimed in claim 11, wherein said stepper drive means are formed so that said months mobile turns through angle of 30° in at least three steps of the days-of-the-month mobile.

20. The timepiece as claimed in claim 11, wherein the angular extent of the distinctive zone is more than the angular extent of one of said windows and at most 30°.

* * * * *